US007631726B2

(12) United States Patent
McWilliam et al.

(10) Patent No.: US 7,631,726 B2
(45) Date of Patent: Dec. 15, 2009

(54) SILENCER FOR AIR INDUCTION SYSTEM AND HIGH FLOW ARTICULATED COUPLING

(75) Inventors: Richard Donald McWilliam, Shedden (CA); Jason Lorne Pettipiece, Chatham (CA); Roderic Cole, Chatham (CA); Fran Warren, Chatham (CA)

(73) Assignee: Mahle International GmbH, Stutgart (DE)

( * ) Notice: Subject to any disclaimer, the term of this patent is extended or adjusted under 35 U.S.C. 154(b) by 203 days.

(21) Appl. No.: 11/148,143

(22) Filed: Jun. 8, 2005

(65) Prior Publication Data

US 2005/0284692 A1 Dec. 29, 2005

Related U.S. Application Data

(60) Provisional application No. 60/583,556, filed on Jun. 28, 2004.

(51) Int. Cl.
*F02M 35/12* (2006.01)
*F01N 1/04* (2006.01)
*F01N 1/06* (2006.01)

(52) U.S. Cl. ..... 181/258; 181/206; 181/229; 181/252; 181/256; 181/264

(58) Field of Classification Search ..... 181/206, 181/229, 252, 256, 258, 210, 211, 264, 265
See application file for complete search history.

(56) References Cited

U.S. PATENT DOCUMENTS

| | | | | | |
|---|---|---|---|---|---|
| 2,808,896 | A * | 10/1957 | Wilman | 181/228 |
| 2,990,028 | A * | 6/1961 | Powers | 181/238 |
| 3,590,946 | A * | 7/1971 | Corn, Jr. | 181/256 |
| 4,346,781 | A * | 8/1982 | Ingard et al. | 181/206 |
| 4,408,679 | A * | 10/1983 | Littrell | 181/243 |
| 5,058,558 | A * | 10/1991 | Ueda et al. | 123/559.1 |
| 5,548,093 | A * | 8/1996 | Sato et al. | 181/224 |
| 5,714,724 | A * | 2/1998 | Menzel | 181/229 |
| 5,979,598 | A | 11/1999 | Wolf | |
| 6,409,784 | B1 * | 6/2002 | Wehr | 55/385.3 |
| 6,439,540 | B1 * | 8/2002 | Tse | 251/127 |
| 6,510,921 | B2 * | 1/2003 | Price | 181/264 |
| 6,802,388 | B2 | 10/2004 | Wolf | |
| 2003/0072459 | A1 * | 4/2003 | Cole et al. | 381/71.7 |
| 2003/0173146 | A1 * | 9/2003 | Wolf et al. | 181/224 |

FOREIGN PATENT DOCUMENTS

| | | | |
|---|---|---|---|
| DE | 197 03414 | | 8/1998 |
| DE | 19943246 | A1 * | 3/2001 |
| DE | 10026355 | A1 * | 1/2002 |
| JP | 60169621 | A * | 9/1985 |

* cited by examiner

*Primary Examiner*—Jeffrey Donels
*Assistant Examiner*—Jeremy Luks
(74) *Attorney, Agent, or Firm*—Carlson, Gaskey & Olds

(57) ABSTRACT

An air induction silencer assembly includes an acoustic interference member disposed within a conduit. The acoustic interference member is tuned to acoustically cancel a selected noise energy frequency. An acoustic absorbing member is also disposed within the conduit. The acoustic absorbing member converts noise energy within the conduit into heat energy to attenuate noise energy within the air induction silencer assembly. The air induction silencer assembly connects to a flexible conduit that includes an inlet portion, an outlet portion, and a flexible joint that connects the inlet portion and the outlet portion together. The flexible joint includes a rolling lobe and a rolling surface. The rolling lobe moves along the rolling surface when the inlet portion moves relative to the outlet portion.

19 Claims, 5 Drawing Sheets

SILENCER FOR AIR INDUCTION SYSTEM AND HIGH FLOW ARTICULATED COUPLING

CROSS-REFERENCE TO RELATED APPLICATIONS

This application claims priority to U.S. Provisional Application No. 60/583,556, filed on Jun. 28, 2004.

BACKGROUND OF THE INVENTION

This invention relates to air induction systems and, more particularly, to an air induction system that includes a silencer to attenuate noise within the air induction system and a flexible conduit that provides a low turbulence connection within the air induction system.

Air induction systems are often used in vehicles to intake air from a surrounding environment and supply the air to a combustion engine. Typically, the air from the surrounding environment is drawn through a conduit to an air filter. The air filter filters the air before the air is supplied to the combustion engine. Some engines use a turbocharger to boost the air pressure in the conduit.

Common turbochargers utilize a rotating fan or intermeshing rotating screws to compress and blow the air. The rotation of the fan or the intermeshing screws produces pulsations of compressed air at a frequency that corresponds to the speed of rotation. The pulsations of compressed air manifest within the air induction system as noise energy. Disadvantageously, the noise energy often results in an undesirable audible sound.

The conduit between the turbocharger and the air filter commonly includes a silencer to attenuate the noise energy and reduce the audible sound. Typical silencers employ chambers that receive the noise energy and reflect the noise energy to acoustically cancel the noise energy and reduce the audible sound. Disadvantageously, these silencers attenuate a relatively small portion of the noise energy, while a remaining portion of the noise energy still results in audible sound.

The conduit between the turbocharger and the air filter also commonly includes a flexible portion that allows the compressed air to travel along a curved flow path into the air filter. Typical flexible portions often include a convoluted tube to allow the flexible portion to bend. Disadvantageously, convoluted walls of the convoluted tube interfere with the flow of air through the flexible portion and produce turbulent air flow. The turbulent air flow often results in decreased amounts of air being supplied to the combustion engine and inefficient combustion.

Accordingly, there is a need for a silencer that more effectively attenuates noise energy and a flexible conduit that reduces turbulent air flow in an air induction system.

SUMMARY OF THE INVENTION

An example air induction silencer assembly according to the present invention includes an acoustic interference member disposed within a conduit. The acoustic interference member is tuned to acoustically cancel a selected noise energy frequency. An acoustic absorbing member is also disposed within the conduit. The acoustic absorbing member converts noise energy within the conduit into heat energy to attenuate noise energy within the air induction silencer assembly.

In another example according to the present invention, the air induction silencer assembly includes an acoustic absorbing member disposed within a first conduit. The acoustic absorbing member converts noise energy within the conduit into heat energy. A second conduit is fluidly connected to the first conduit. The second conduit includes an inlet portion, an outlet portion, and a flexible joint that connects the inlet portion and the outlet portion together. The flexible joint includes a rolling lobe and a rolling surface. The rolling lobe moves along the rolling surface when the inlet portion moves relative to the outlet portion.

An example flexible conduit according to the present invention includes an inlet portion, an outlet portion, and a flexible joint that connects the inlet portion and the outlet portion together. The flexible joint includes a rolling lobe and a rolling surface. The rolling lobe moves along the rolling surface when the inlet portion moves relative to the outlet portion.

Accordingly, this invention provides a silencer that more effectively attenuates noise energy and a flexible conduit that reduces turbulent air flow in an air induction system, while avoiding the shortcomings and drawbacks of the prior art.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
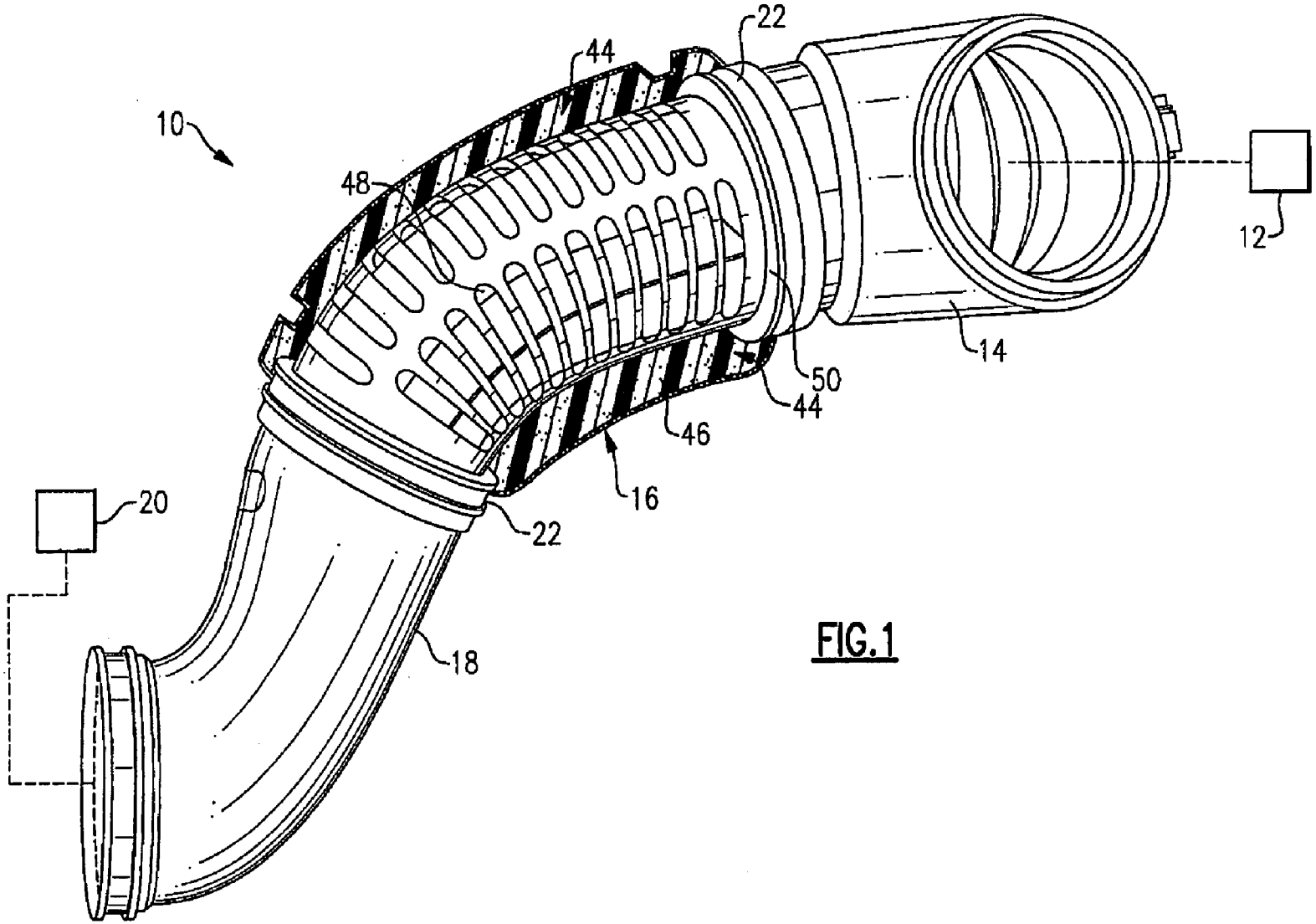
FIG. 1 shows a perspective view of an example air induction system.

FIG. 1 illustrates selected portions of an example air induction system 10 of a combustion engine vehicle for example. The air induction system 10 includes an air filter 12 connected to a flexible conduit 14. The flexible conduit 14 connects to a silencer 16 that provides noise attenuation of noise energy. The silencer 16 connects to a duct 18 that leads into a turbocharger 20. Connector members 22 secure the flexible conduit 14, the silencer 16, and the duct 18 together. During operation of the vehicle, air from a surrounding environment travels into the air filter 12. The air filter 12 removes dirt, dust, and debris for example from the air before the air enters the flexible conduit 14, silencer 16, and duct 18.

Figure 2:
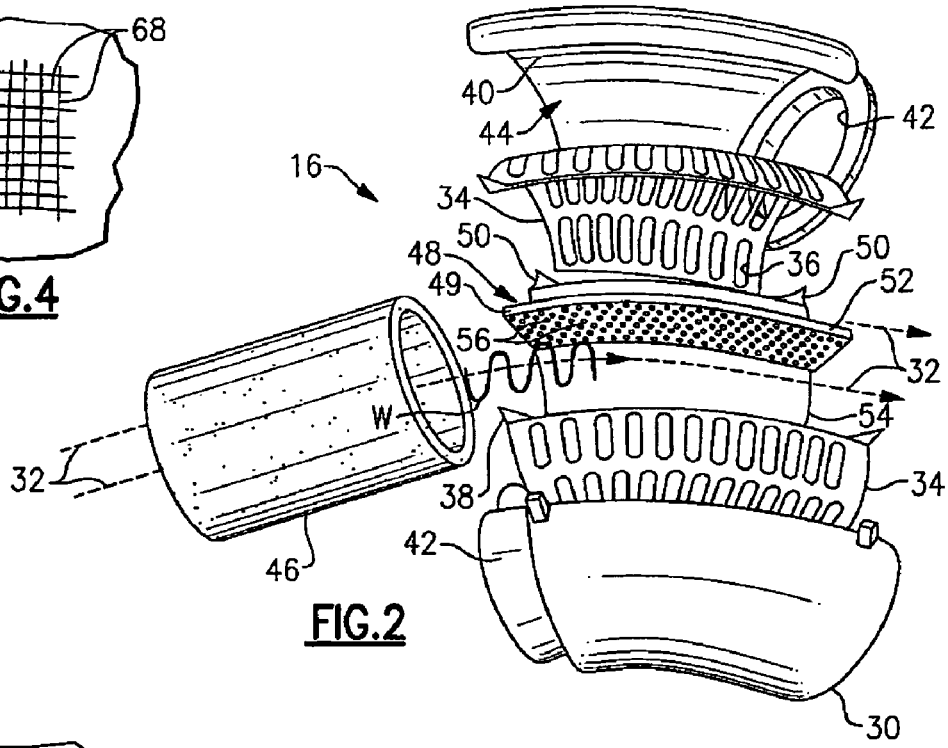
FIG. 2 shows an exploded view of an example silencer assembly.

FIG. 2 illustrates an exploded view of the silencer 16 of FIG. 1. The silencer 16 includes an outer cover 30 that defines a conduit along a flow channel 32 through the outer cover 30. In one example, the outer cover 30 is made of a molded plastic material. In the illustrated example, a cage 34 is disposed inside of the outer cover 30. The cage 34 includes cage openings 36, as described below, and securing members 38. The securing members 38 contact an inner surface 40 and a lip 42 of the outer cover 30. The securing members 38 secure the cage 34 within the outer cover 30 such that the cage 34 is prevented from moving laterally along the flow channel 32.

The securing members 38 also space the cage 34 from the outer cover 30 to define an annular space 44 between the outer cover 30 and the cage 34. An acoustic absorbing member 46 is disposed in the annular space 44. The cage 34 restrains the acoustic absorbing member 46 such that the acoustic absorbing member 46 is prevented from protruding into the flow channel 32 and interfering with air flow through the silencer 16. The cage 34 also provides the benefit of restraining and preventing portions of the acoustic absorbing member 46 from breaking loose into the flow channel 32.

Figure 2A:
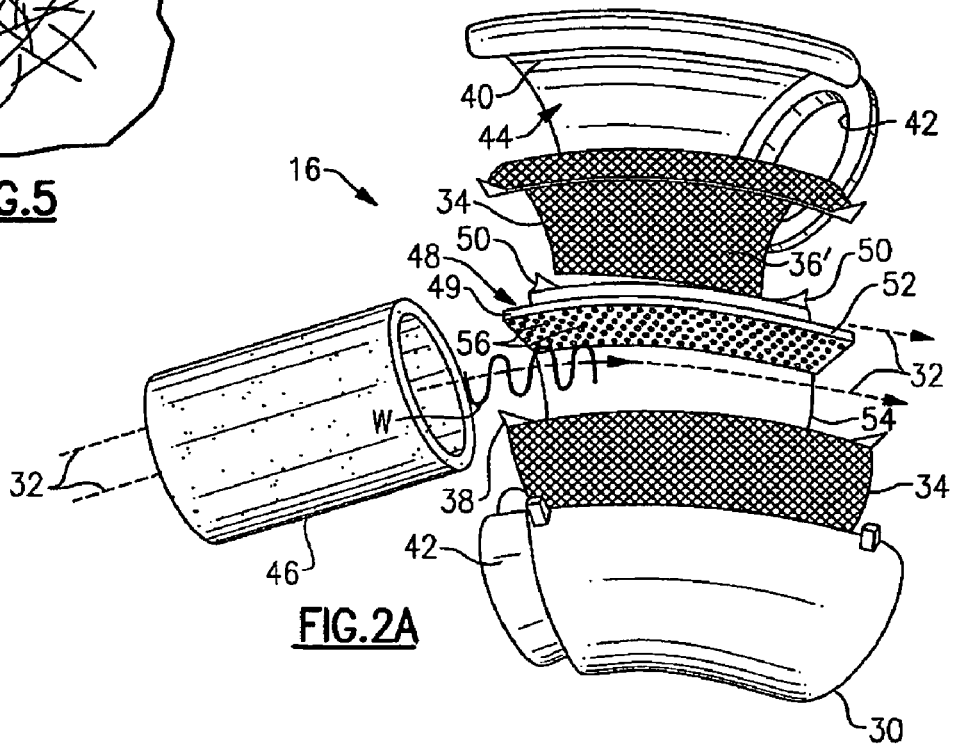
FIG. 2A shows an exploded view of another example silencer assembly.

The cage openings 36 correspond to the type of material used for the acoustic absorbing member 46. In the illustrated example, the acoustic absorbing member 46 is made of a foam material such that the acoustic absorbing member 46 is a single piece of foam. The single piece of foam requires minimal restraint from the cage 34 to prevent the single piece of foam from protruding into the flow channel 32. In another example, the cage openings are smaller than illustrated in FIG. 2, and correspond to, for example, a mesh screen (see FIG. 2*a*) to prevent relatively small, separable pieces of the acoustic absorbing member 46 from protruding or breaking off into the flow channel 32. In the mesh screen example, the cage 34 is a mesh and the openings 36' correspond to openings in the mesh.

In the illustrated example, the cage 34 is acoustically porous such that noise energy traveling through the silencer 16 can impinge upon the acoustic absorbing material through the cage openings 36.

Figure 3:
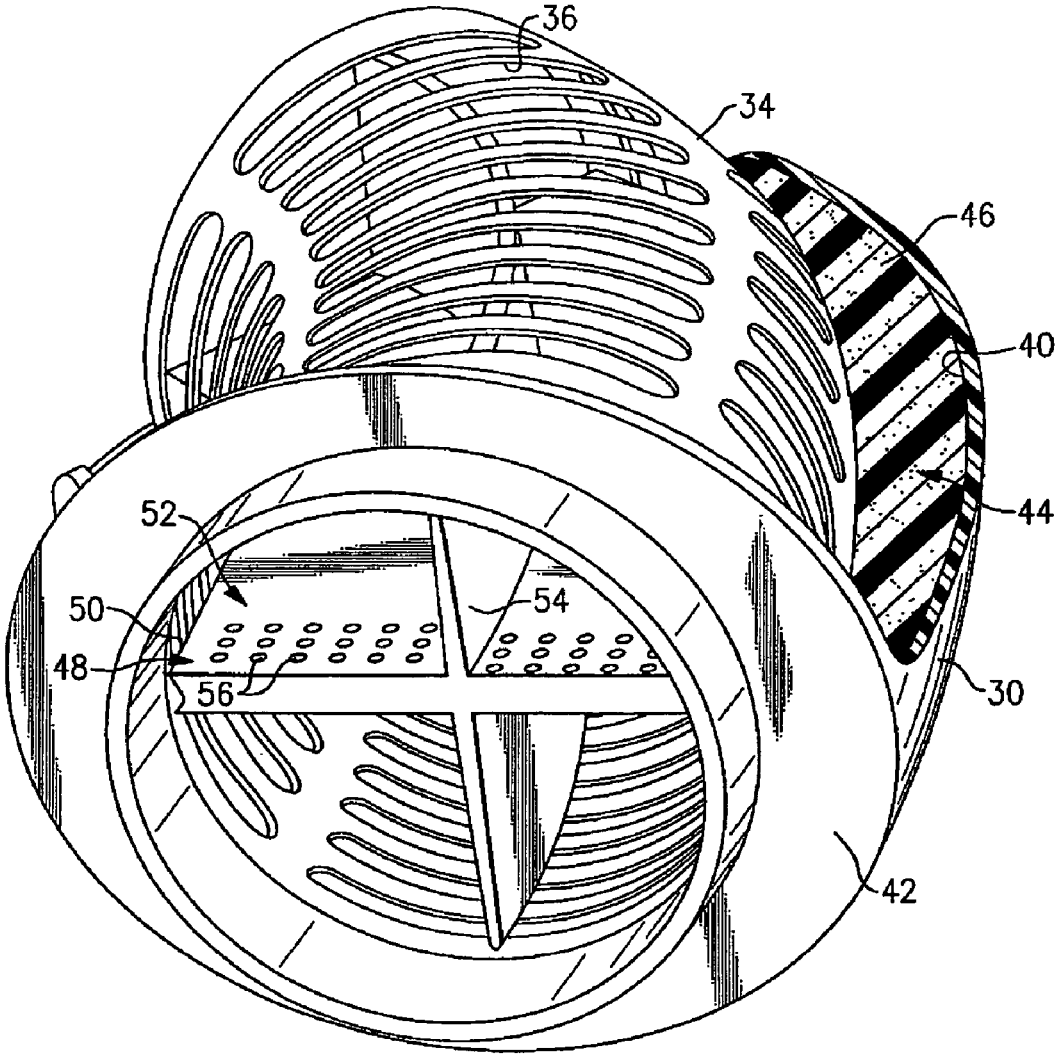
FIG. 3 shows a perspective view of an example silencer assembly.

An acoustic interference member 48 having a periphery 49 is disposed radially inward of the cage 34 and the acoustic absorbing member 46 (FIG. 3). The acoustic interference member 48 includes locking members 50 that interlock with one of the cage openings 36 to secure the acoustic interference member 48 within the cage 34. In the illustrated example, the outer cover 30 therefore supports the cage 34, and the cage 34 supports the acoustic interference member 48. This feature provides the benefit of a tight fit between the outer cover 30, the cage 34, the acoustic absorbing member 46, and the acoustic interference member 48.

The acoustic interference member includes a first plate 52 and a second plate 54 configured in the shape of a cross. The first plate 52 and the second plate 54 are curved such that air flow is directed along the flow channel 32. In the illustrated example, the first plate 52 and the second plate 54 are integrated (e.g., by injection molding) such that the acoustic interference member 48 is a single piece. However, it is to be understood that the first plate 52 and the second plate 54 could also be two or more separate pieces.

In the illustrated example, the first plate 52 includes a plurality of blind holes 56. Each of the blind holes 56 has an associated depth that corresponds to a noise energy wavelength. The depths of the blind holes 56 are selected (i.e., tuned) to acoustically cancel selected wavelengths of noise energy that are expected to travel through the silencer 16 from the turbocharger 20 during operation of the vehicle. As is known, a wavelength of a frequency of noise energy will travel along the blind hole 56 and reflect off of an end of the blind hole 56. The reflected noise energy is 180° out of phase with the noise energy entering the blind hole 56 and therefore acoustically cancels the entering noise energy. This provides the benefit of attenuating at least a portion of the noise energy from the turbocharger 20.

In one example, the blind holes 56 include at least two different depths in order to attenuate at least two corresponding noise energy wavelengths. In another example, the depths are less than 15 mm in order to attenuate noise energy within a selected corresponding range.

In the illustrated example, the first plate 52 and the second plate 54 separate the flow channel 32 into four flow channel quadrants. The first plate 52 and the second plate 54 guide the air flow entering the silencer 16. The separation and guidance of the air flow provide the benefit of preventing pressure build-ups and pressure drops within the silencer 16.

The acoustic absorbing member 46 provides additional noise energy attenuation. The acoustic absorbing member 46 receives at least a portion of the noise energy that travels into the silencer 16. The acoustic absorbing member 46 absorbs the noise energy. The noise energy causes movement (e.g., microscopic movement) of the acoustic absorbing member 46, which results in internal friction between the chemical molecules of the acoustic absorbing member 46. The internal friction results in the production of heat. The acoustic absorbing member 46 provides the benefit of absorbing noise energy within the silencer 16, converting the noise energy to heat, and dissipating the heat to the surrounding environment. In one example, a noise energy wave W propagating through the silencer impinges upon the acoustic absorbing member 46 in an essentially perpendicular direction. The acoustic absorbing material absorbs a significant portion of the noise energy wave W to essentially eliminate the noise energy wave W.

The combination of the acoustic absorbing member 46 and the acoustic interference member 48 provides the benefit of more effective noise attenuation within the silencer 16 compared to previously known silencers. The acoustic interference member 48 attenuates a portion of the noise energy that travels within the air induction system 10 and the acoustic absorbing member 46 attenuates another portion of the noise energy within the air induction system (i.e., a portion not attenuated by the acoustic interference member 48).

Figure 4:
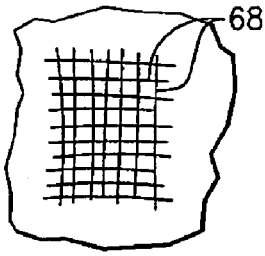
FIG. 4 shows an example acoustic absorbing material.
Figure 5:
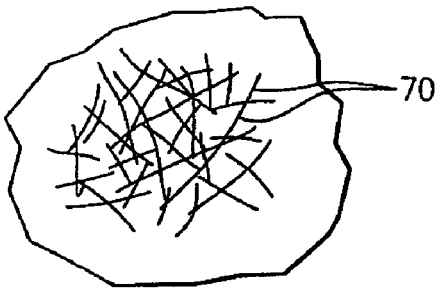
FIG. 5 shows another example of an acoustic absorbing material.

In the illustrated example, the acoustic absorbing member 46 includes a foam material. The foam material is flexible and therefore is receptive to receiving and absorbing the noise energy. In another example, the acoustic absorbing member includes woven fibers 68, as illustrated in FIG. 4. In another example, the acoustic absorbing member 46 includes a non-woven fibers 70, as illustrated in FIG. 5. The woven fibers 68 and non-woven fibers 70 absorb noise energy and convert the noise energy to heat, as described above for the foam material.

Figure 6:
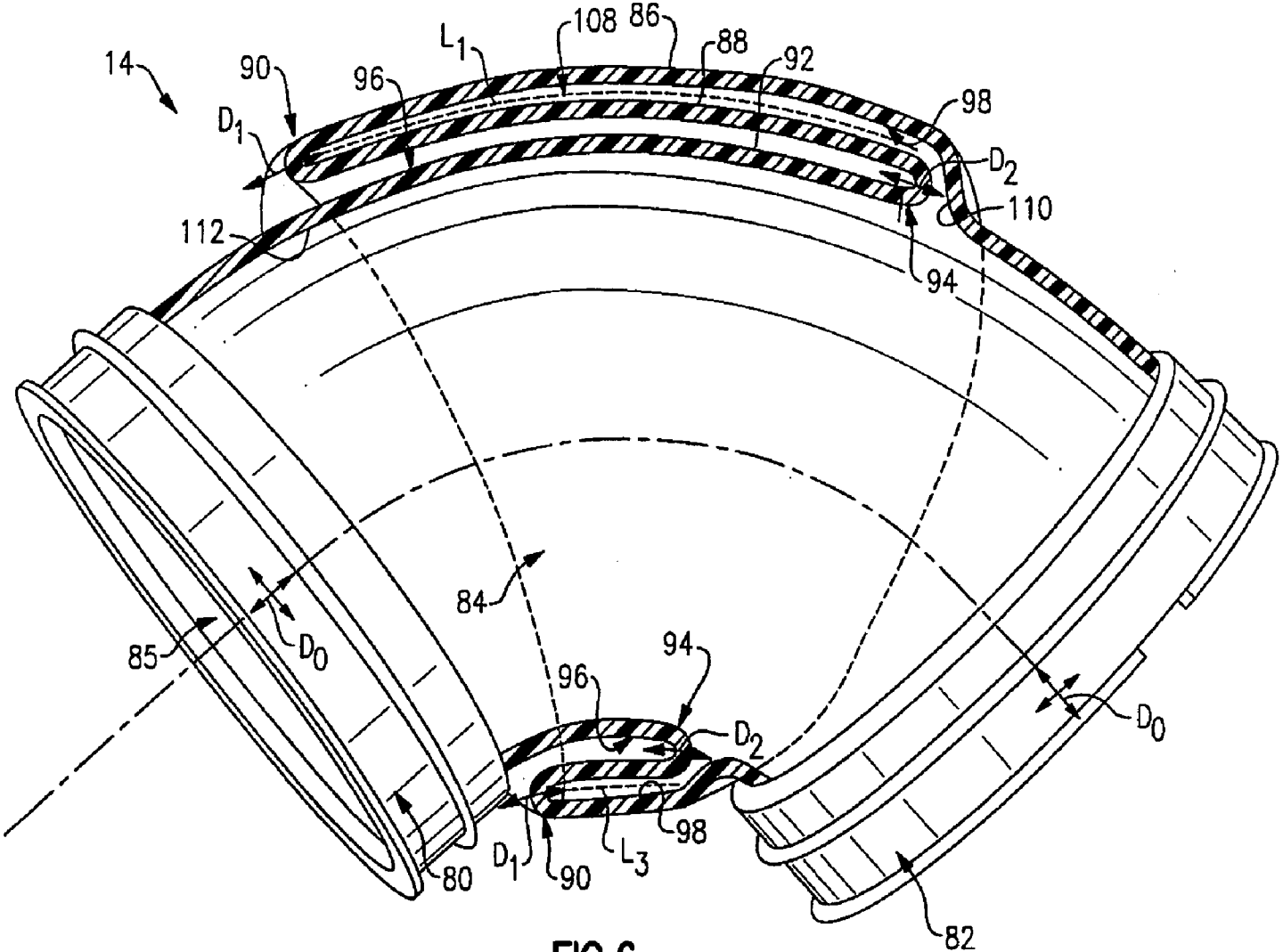
FIG. 6 shows a perspective view of an example flexible conduit.

Air exiting the flexible conduit 14 enters the silencer 16. FIG. 6 illustrates a perspective view of the flexible conduit 14 of FIG. 1. The flexible conduit 14 includes an inlet portion 80, an outlet portion 82, and a flexible joint 84 that define a flow channel 85 through the flexible conduit 14. The flexible joint 84 allows the inlet portion 80 and the outlet portion 82 to move relative to each other. This provides the benefit of directing the compressed airflow through the flexible conduit 14 along a curved flow path from the air filter 12.

In the illustrated example, the flexible conduit 14 is made from a flexible material such as an elastomer. In one example, the elastomer includes ethylene propylene diene methylene (EPDM) and resists temperatures at least between −40° C. and 120° C. The flexible conduit is injection molded in a known manner.

The configuration of the flexible joint 84 is shown schematically over the perspective view in FIG. 6. The flexible joint 84 includes a first conduit wall portion 86 that is folded relative to a second conduit wall portion 88 such that the first conduit wall portion 86 overlaps the second conduit wall portion 88 to form a first rolling lobe 90. The first conduit wall portion 86 and the second conduit wall portion 88 are folded relative to a third conduit wall portion 92 to form a second rolling lobe 94.

During movement of the inlet portion 80 relative to the outlet portion 82, the first rolling lobe moves along a first rolling surface 96 in a direction $D_1$. The second rolling lobe 94 moves along a second rolling surface 98 in a direction $D_2$. The movement of the first rolling lobe 90 and the second rolling lobe 94 along one of the directional movements $D_o$ allows the inlet portion 80 to move relative to the outlet portion 82, as will be described below.

In one example, the elastomer material of the flexible conduit 14 includes an internal lubricant. The internal lubricant reduces friction between the first rolling lobe 90 and the first rolling surface 96 and the second rolling lobe 94 and the second rolling surface 98. This feature provides the advantage of reduced wear between the rolling lobes 90 and 94 and the respective rolling surfaces 96 and 98. In one example, the internal lubricant includes a lubricious material such as a wax.

In the illustrated example, the flexible joint 84 includes an interior space 108 between the first conduit wall portion 86 and the second conduit wall portion 88. An opening 110 connects the interior space 108 to the flow channel 85. In one example, the interior space 108 receives noise energy from the turbocharger 20. The noise energy enters the interior space 108 through the opening 110. The interior space 108 includes a length $L_1$. Although the length $L_1$ changes as the first and second rolling lobes 90 and 94 move, the length $L_1$ is relatively constant once the flexible conduit 14 is installed into a vehicle. That is, the length $L_1$ can be predetermined such that the length $L_1$ is about 25% of a selected noise energy wavelength to acoustically cancel the selected noise energy wavelength (as described above for the blind holes 56). This provides the benefit attenuating at least a portion of the noise energy from the turbocharger 20.

In another example, a size of the opening 110 corresponds to a selected noise energy wavelength and frequency. Together, the interior space 108 and the opening 110 form a Helmholtz resonator to dampen the selected noise energy wavelength and frequency. The principles of a Helmholtz resonator are known and hereby incorporated by reference.

The combination of the acoustic absorbing member 46, the acoustic interference member 48, and the interior space 108 of the flexible conduit 14 provides the benefit of more effective noise attenuation within the air induction system 10 compared to previously known air induction systems. In one example, each of the acoustic absorbing member 46, the acoustic interference member 48, and the interior space 108 are tuned to attenuate different noise energy frequencies. This results in attenuation over a wider range of frequencies compared to previously known air induction systems.

The flexible conduit 14 also provides a low turbulence connection between the turbocharger 20 and the air filter 12 compared to previously known convoluted flexible conduits. An interior surface 112 of the flexible conduit 14 is smooth and does not significantly interfere with compressed air flowing through the flow channel 85. This provides a low turbulence connection into the air filter 12 while allowing the compressed air to flow along a curved path (i.e., flow channel 85).

Figure 7:
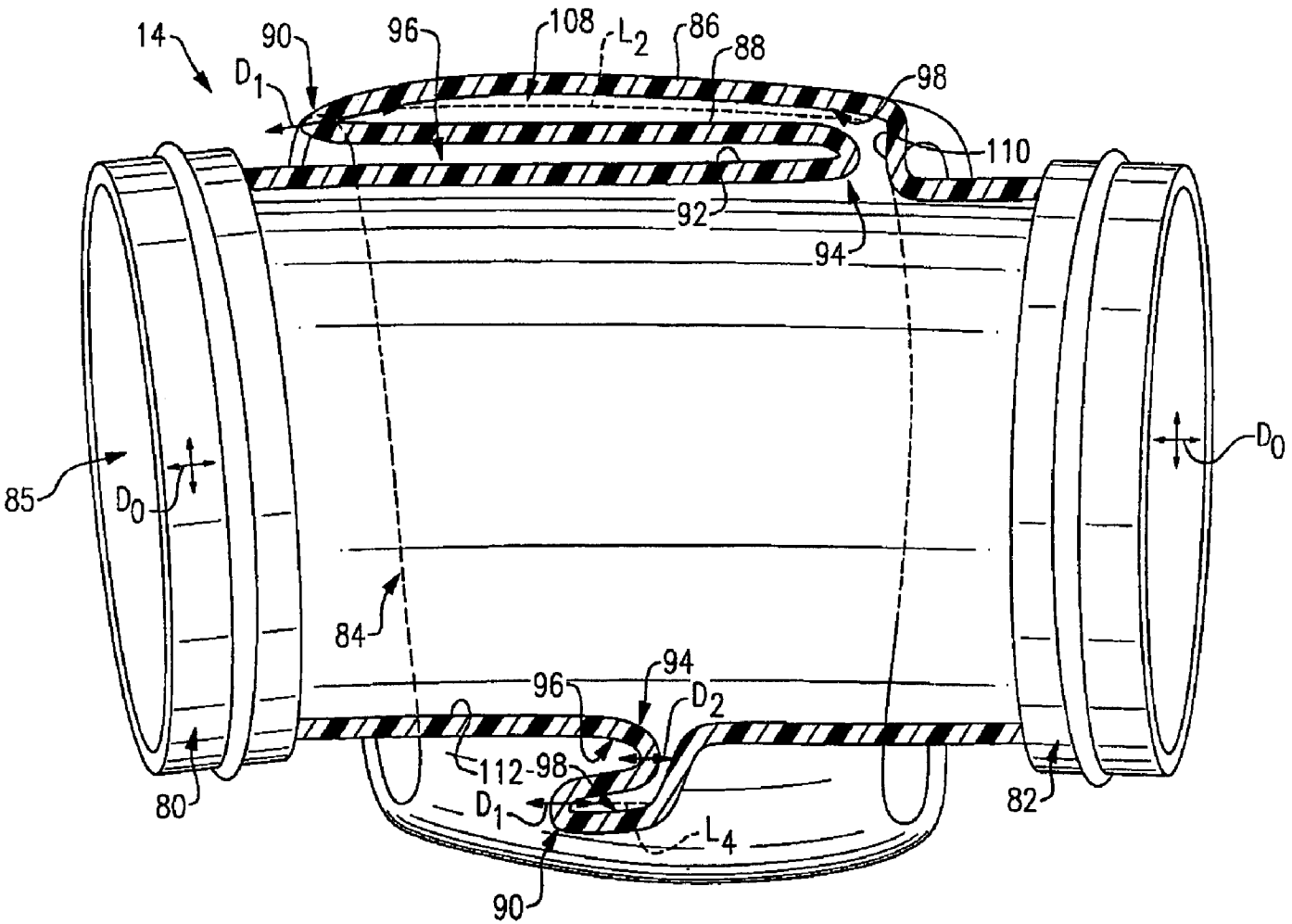
FIG. 7 shows a perspective view of the flexible conduit of FIG. 5 in a different configuration.

During movement of the flexible joint 84 from the configuration shown in FIG. 6 to the configuration shown in FIG. 7, the length $L_1$ of the interior portion 108 near the top of the flexible joint 84 (top relative to FIG. 7) increases from $L_1$ to $L_2$, for example, as the first rolling lobe 90 moves towards the inlet portion 80 along the first rolling surface 96. As the first rolling lobe 90 moves, the first conduit wall portion 86 folds under and into the second conduit wall portion 88. Likewise, the third conduit wall portion 92 folds into the second conduit wall portion 88 at the second rolling lobe 94. The length $L_3$ of the interior portion 108 near the bottom of the flexible joint 84 decreases from $L_3$ to $L_4$, for example, as the first rolling lobe 90 moves towards the inlet portion 80.

It is to be recognized that opposite movement of the inlet portion 80 relative to the outlet portion 82 will cause, for example, the second conduit wall portion 88 to fold into the first conduit wall portion 86. The folding (i.e., rolling) of the first conduit wall portion 86 relative to the second conduit wall portion 88 and folding of the third conduit wall portion 92 relative to the second conduit wall portion 88 allows the inlet portion 80 to move relative to the outlet portion 82. It is to be recognized also that folding of either the first conduit wall portion 86 relative to the second conduit wall portion 88 or folding of the third conduit wall portion 92 relative to the second conduit wall portion 88 (i.e., rolling of only one of the first rolling lobe 90 or the second rolling lobe 94) will allow movement of the inlet portion 80 relative to the outlet portion 82.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. An air induction silencer assembly comprising:

an outer cover defining a conduit;

an acoustic interference member disposed within the conduit, the acoustic interference member being tuned to acoustically cancel a selected noise energy frequency, wherein the acoustic interference member includes a first plate and a second plate configured in the shape of a cross, wherein the first plate includes a plurality of blind holes, and the second plate is solid;

an acoustic absorbing member disposed within the conduit, wherein the acoustic absorbing member converts noise energy within the conduit into heat energy; and a cage disposed within the outer cover, the cage defining an annular space between the outer cover and the cage and including a plurality of elongated openings that extend circumferentially around the cage, the elongated openings being longer in a circumferential direction than in an axial direction, and an axial length of the elongated openings being greater than a thickness of the cage.

2. The assembly as recited in claim 1, wherein the cage includes a securing member that secures the cage relative to the outer cover.

3. The assembly as recited in claim 1, wherein the acoustic interference member includes a locking member that interlocks with the cage to secure the acoustic interference member and the cage together.

4. The assembly as recited in claim 1, wherein the outer cover supports the cage and the cage supports the acoustic interference member within the conduit.

5. The assembly as recited in claim 1, wherein the acoustic absorbing material is disposed within the annular space.

6. The assembly as recited in claim 1, wherein the acoustic absorbing member includes a foam material.

7. The assembly as recited in claim 1, wherein the acoustic absorbing member is disposed about a periphery of the acoustic interference member.

8. The assembly as recited in claim 7, wherein the acoustic absorbing member includes a cylindrical sleeve having an interior portion and the acoustic interference member is disposed within the interior portion.

9. The assembly as recited in claim 1, wherein each of the plurality of blind holes includes a depth, and the depth is less than 15 mm.

10. The assembly as recited in claim 1, wherein the plurality of blind holes includes a first blind hole having a first depth and a second blind hole having a second depth that is different than the first depth.

11. The assembly as recited in claim 1, wherein at least one of the plurality of blind holes includes a depth that is about 25% of a selected wavelength to acoustically cancel the selected wavelength.

12. The assembly as recited in claim 1, wherein the acoustic absorbing member includes a non-woven fiber material.

13. The assembly as recited in claim 1, wherein the acoustic absorbing member includes a foam material or a woven fiber material.

14. The assembly as recited in claim 1, wherein each of the plurality of openings includes a section having a uniform width.

15. The assembly as recited in claim 14, wherein the plurality of openings are grouped into a plurality of sets of openings.

16. The assembly as recited in claim 15, wherein each opening in each of the plurality of sets of openings are equally spaced axially along the cage.

17. The assembly as recited in claim 1, wherein the cage is radially inside the acoustic absorbing member.

18. An air induction silencer assembly comprising:

an outer cover defining a conduit;

an acoustic interference member disposed within the conduit, the acoustic interference member being tuned to acoustically cancel a selected noise energy frequency;

an acoustic absorbing member disposed within the conduit, wherein the acoustic absorbing member converts noise energy within the conduit into heat energy, wherein the acoustic interference member includes a plate having a plurality of blind holes, and wherein the plate includes a curved portion that corresponds to a bend in the conduit; and a cage disposed within the outer cover, the cage defining an annular space between the outer cover and the cage and including a plurality of elongated openings that extend circumferentially around the cage, the elongated openings being longer in a circumferential direction than in an axial direction, and an axial length of the elongated openings being greater than a thickness of the cage.

19. An air induction silencer assembly comprising:

an outer cover defining a conduit;

an acoustic interference member disposed within the conduit, the acoustic interference member being tuned to acoustically cancel a selected noise energy frequency, wherein the acoustic interference member includes a first plate and a second plate that intersects the first plate, wherein the first plate includes a plurality of blind holes, and wherein the second plate is free of blind holes;

an acoustic absorbing member disposed within the conduit, wherein the acoustic absorbing member converts noise energy within the conduit into heat energy; and a cage disposed within the outer cover, the cage defining an annular space between the outer cover and the cage and including a plurality of elongated openings that extend circumferentially around the cage, the elongated openings being longer in a circumferential direction than in an axial direction, and an axial length of the elongated openings being greater than a thickness of the cage.

* * * * *